US007628276B2

(12) United States Patent
Kirsch et al.

(10) Patent No.: US 7,628,276 B2
(45) Date of Patent: Dec. 8, 2009

(54) BANNER GREETING METHOD AND DEVICE

(76) Inventors: Judy Kirsch, 1964 Edge Road, Syosset, NY (US) 11791; Ann Strumer, 34 Harriet Dr., Syosset, NY (US) 11791

( * ) Notice: Subject to any disclaimer, the term of this patent is extended or adjusted under 35 U.S.C. 154(b) by 504 days.

(21) Appl. No.: 11/539,951

(22) Filed: Oct. 10, 2006

(65) Prior Publication Data

US 2007/0235353 A1 Oct. 11, 2007

Related U.S. Application Data

(60) Provisional application No. 60/791,142, filed on Apr. 11, 2006.

(51) Int. Cl.
*B65D 85/00* (2006.01)

(52) U.S. Cl. ..... 206/575; 206/232; 206/459.5

(58) Field of Classification Search ..... 206/232, 206/449, 457, 459.5, 575; 40/604, 606.3, 40/617; 53/411, 443
See application file for complete search history.

(56) References Cited

U.S. PATENT DOCUMENTS 4,434,889 A * 3/1984 Fery ..... 206/216
2003/0089083 A1* 5/2003 Phillips ..... 53/411
2003/0098356 A1* 5/2003 Gombar ..... 206/232
2005/0246928 A1* 11/2005 Lee ..... 40/564
2007/0029222 A1* 2/2007 Shepardson ..... 206/457

* cited by examiner

*Primary Examiner*—Luan K Bui
(74) *Attorney, Agent, or Firm*—Ostrolenk Faber LLP

(57) ABSTRACT

A greeting product and method for conveying a greeting may utilize a banner-shaped greeting structure and a container therefor, the greeting structure having indicia constituting a greeting message, the greeting structure having an extended position in which it is adapted for being displayed, and having a compacted position, and the container being shaped and sized for receiving the greeting structure in its compacted position. The greeting product and the container may have substantially matching shapes when the greeting structure is in the compacted position. The greeting structure may include a plurality of similarly shaped units, linked together. Portions of a greeting message may be placed on respective ones of the units. The units may be polygonal, or at least partially rounded, circular or any other desired shape. The container itself may also have indicia related to the greeting message. A second greeting structure may be placed in the container having additional indicia related to the greeting message.

15 Claims, 2 Drawing Sheets

BANNER GREETING METHOD AND DEVICE

CROSS REFERENCE TO RELATED APPLICATION

This application is based upon and claims priority of U.S. Provisional Ser. No. 60/791,142 filed Apr. 11, 2006, incorporated by reference.

BACKGROUND OF THE INVENTION

The present invention relates to a method and product for conveying greetings, and more particularly to a product comprising a container and a banner-type greeting contained therein.

SUMMARY OF THE INVENTION

The present invention provides a novel means and method of sending greetings, such as for an anniversary, birthday, get well, congratulations, graduation, wedding, engagement, or any other desired type of greeting.

The greeting is preferably suitable for being displayed after removal from the container.

The greeting comprises a container, with decoration and/or a message on a visible part thereof; and a banner-shaped greeting contained therein. The greeting may comprise a banner made of a continuous strip bearing a message written along the length of the strip; or the greeting may comprise a set of segments, such as cards, each with a part of a message and linked together, for example by a separate strip attached to each segment, to form a continuous banner. Any elongated greeting structure that may be compacted and combined with a container is within the scope of the invention.

Additional elements may be included. Congratulations on a new home may comprise, in addition to the container and banner greeting, a picture of the home, either inside or outside the container, or both. An announcement of a change of address may comprise, in addition to the container and banner greeting, a map to the new address. A birth announcement may contain information about the birth or a picture of the baby.

Banners may be manufactured and maintained as a stock item, such as "congratulations!" or "hooray!", which apply to many situations. The containers may also be maintained as a stock item if desired. The containers and banners may alternatively have supporting information for specific situations such as birth, graduation, etc., may be stocked separately and brought together with the banner at the point of sale.

According to preferred features of the invention, a greeting product and method for conveying a greeting may utilize a banner-shaped greeting structure and a container therefor, the greeting structure having indicia constituting a greeting message, the greeting structure having an extended position in which it is adapted for being displayed, and having a compacted position, and the container being shaped and sized for receiving the greeting structure in its compacted position.

The greeting product and the container may have substantially matching shapes when the greeting structure is in the compacted position.

The greeting structure may include a plurality of similarly shaped units, linked together. Portions of a greeting message may be placed on respective ones of the units. The units may be polygonal, or at least partially rounded, circular or any other desired shape.

The container itself may also have indicia related to the greeting message. A second greeting structure may be placed in the container having additional indicia related to the greeting message.

Other features and advantages of the present invention will become apparent from the following description of examples of the invention, with reference to the accompanying drawings.

DETAILED DESCRIPTION OF EMBODIMENTS OF THE INVENTION

Figure 1:
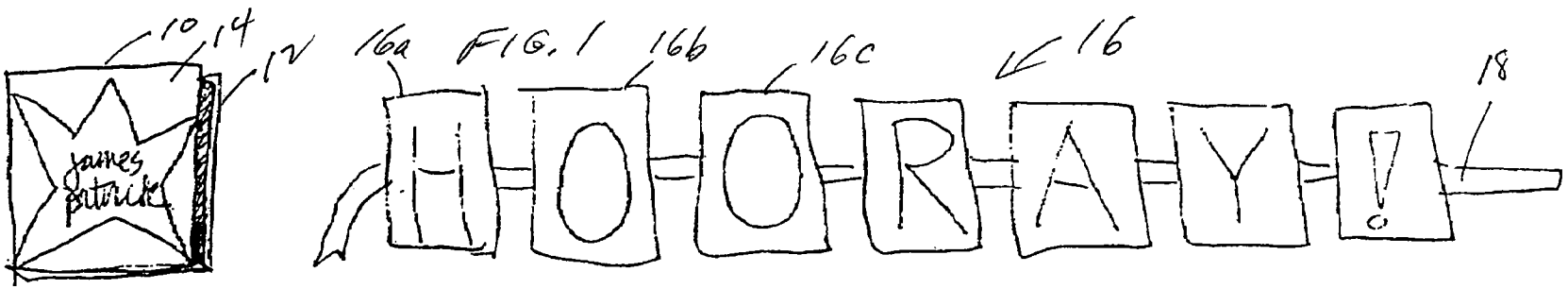
FIG. 1 is a perspective view showing an example of the invention.

FIG. 1 is an example of the invention, showing a birth announcement. A tin container 10 has on the front a star and the name "James Patrick." In this case the container has a separate base 12 and lid 14, but it may be hinged, or have any other mechanical form. It may be made of plastic, metal, wood or any other material. A flat shape is preferred for mailing in an envelope. In this example, the corners of the container are rounded.

Inside the container is information, such as a printed card with baby information, or a photograph, or a blank card for a personal message from the sender.

Also inside the container is a banner-shaped greeting 16, which in this example comprises a series of cards 16*a*, 16*b*, etc., each affixed to a ribbon 18. A series of cards folds into a compact package for being held in the container, which may have substantially the same shape. In this example, the cards are substantially square, with rounded corners, and substantially match the shape of the container. Round cards in a round container would have similar advantages. The banner-shaped greeting may also be in the form of a continuous strip as mentioned above.

Figure 2:
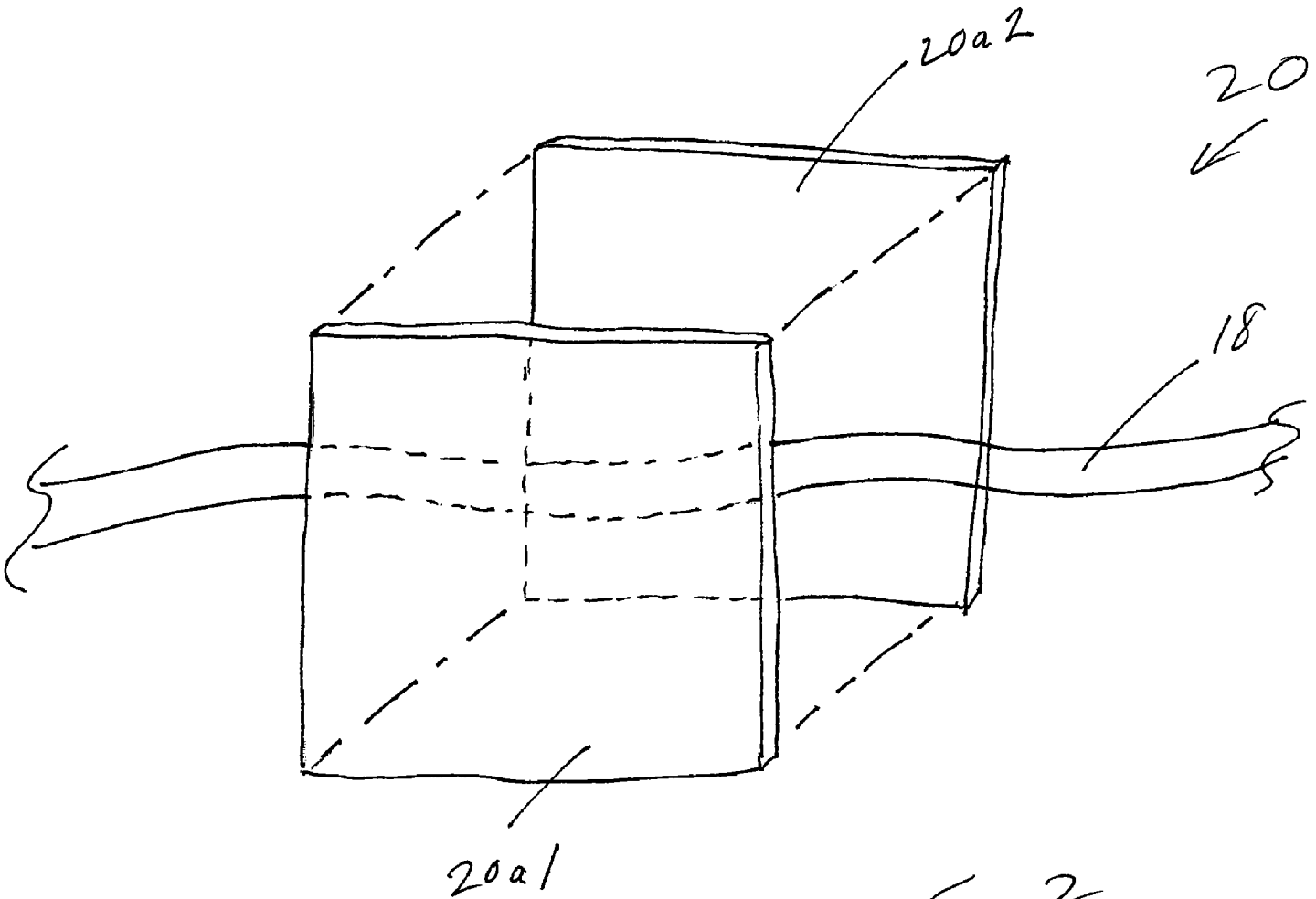
FIG. 2 is an exploded view showing one of the greeting structure units in the example of FIG. 1.

According to a particularly advantageous form of the invention, shown in exploded view in FIG. 2, the segments 20*a*, 20*b*, 20*c* of the banner-type greeting may each comprise a pair of cards (only two cards 20*a*1 and 20*a*2 being shown) affixed together with the ribbon 18 in between. The cards 20*a*1, 20*b*1, etc. on one side of the ribbon may spell out one message, and the cards 20*a*2, 20*b*2, etc. on the other side of the ribbon may spell out the same or a different message.

Although the present invention has been described in relation to particular embodiments thereof, many other variations and modifications and other uses will become apparent to those skilled in the art. Therefore, the present invention is not limited by the specific disclosure herein.

What is claimed is:

1. A greeting product, comprising a banner-shaped greeting structure and a container therefor;

said greeting structure comprising a plurality of units having respective indicia thereon which together constitute a greeting message, having an extended position in which it is adapted for being displayed, and having a compacted position;

wherein said plurality of units have substantially a same shape;

wherein said plurality of units are linked by being secured to a single elongated linking member;

wherein said units are stacked when in said compacted position, with said linking member folded between said stacked units;

said container being sized for receiving said stacked units in said compacted position; and wherein said container has a shape substantially matching that of said stacked units when in said compacted position.

2. The greeting product of claim 1, wherein said units have respective indicia which together comprise said greeting message.

3. The greeting product of claim 1, wherein said shape is substantially quadrilateral.

4. The greeting product of claim 3, wherein said shape is substantially square.

5. The greeting product of claim 1, wherein said shape is at least partially rounded.

6. The greeting product of claim 5, wherein said shape is quadrilateral with rounded corners.

7. The greeting product of claim 1, further comprising indicia on said container related to said greeting message.

8. The greeting product of claim 1, wherein said container comprises a base and a lid which are separable and which together form a volume sized and shaped for receiving and enclosing said greeting structure.

9. The greeting product of claim 1, wherein said linking member passes through a portion of each of said plurality of units.

10. A greeting product, comprising a banner-shaped greeting structure and a container therefor;

said greeting structure having indicia thereon which constitute a greeting message, having an extended position in which it is adapted for being displayed, and having a compacted position;

said container being shaped and sized for receiving said greeting structure in said compacted position;

wherein said container has a shape, said greeting structure having a substantially matching shape when in said compacted position;

wherein said greeting structure comprises a plurality of units each having substantially said shape, linked together;

wherein said plurality of units are each secured to a single elongated linking member; and wherein each of said units comprises a pair of sub-units having substantially said shape, sandwiching said elongated linking member.

11. A method of conveying a greeting, comprising the steps of:

providing a banner-shaped greeting structure and a container therefor;

said greeting structure comprising a plurality of units having respective indicia thereon which together constitute a greeting message, having an extended position in which it is adapted for being displayed, and having a compacted position;

wherein said plurality of units have substantially a same shape;

linking said plurality of units by securing said plurality of units to a single elongated linking member;

stacking said units to form said compacted position with said linking member being folded between said stacked units;

said container being sized for receiving said stacked units in said compacted position; and providing said container with a shape substantially matching the shape of said stacked units when in said compacted position.

12. A method of conveying a greeting, comprising the steps of:

providing a banner-shaped greeting structure and a container therefor;

said greeting structure having indicia thereon which constitute a greeting message, having an extended position in which it is adapted for being displayed, and having a compacted position;

said container being shaped and sized for receiving said greeting structure in said compacted position;

wherein said container is provided with a shape, said shape substantially matching the shape of said greeting structure when in said compacted position;

wherein said greeting structure is formed of a plurality of units each having substantially said shape, linked together;

comprising the step of securing each of said plurality of units to a single elongated linking member; and wherein each of said units is formed of a pair of sub-units having substantially said shape, sandwiching said elongated linking member.

13. The method of claim 12, comprising the step of placing on said units respective indicia which together comprise said greeting message.

14. The method of claim 12, further comprising the step of placing indicia on said container related to said greeting message.

15. The method of claim 12, comprising the step of passing said linking member through a portion of each of said plurality of units.

* * * * *